US008104828B2

(12) United States Patent
Knighton

(10) Patent No.: US 8,104,828 B2
(45) Date of Patent: Jan. 31, 2012

(54) ADJUSTABLE WORKSTATION WITH HIDEAWAY SEAT AND METHOD

(76) Inventor: William Knighton, Schofield, WI (US)

( * ) Notice: Subject to any disclaimer, the term of this patent is extended or adjusted under 35 U.S.C. 154(b) by 0 days.

(21) Appl. No.: 13/096,926

(22) Filed: Apr. 28, 2011

(65) Prior Publication Data

US 2011/0203492 A1 Aug. 25, 2011

Related U.S. Application Data

(63) Continuation of application No. 12/270,709, filed on Nov. 13, 2008, now Pat. No. 7,954,892.

(51) Int. Cl.
*A47B 39/00* (2006.01)
*A47B 83/00* (2006.01)

(52) U.S. Cl. ..... 297/142; 297/172; 297/174 R

(58) Field of Classification Search ..... 297/135, 297/140, 141, 142, 144, 170, 171, 172, 174 R
See application file for complete search history.

(56) References Cited

U.S. PATENT DOCUMENTS

| | | | | | |
|---|---|---|---|---|---|
| 57,255 | A | * | 8/1866 | Efaw | 297/142 |
| 367,037 | A | | 7/1887 | Canaday | |
| 682,297 | A | | 9/1901 | Tucker | |
| 822,182 | A | | 5/1906 | Cassel | |
| 1,182,850 | A | | 5/1916 | Little | |
| 1,322,551 | A | * | 11/1919 | Marx | 297/241 |
| 1,407,405 | A | | 2/1922 | Girard | |
| 1,652,100 | A | | 12/1927 | Eastburn | |
| 2,524,187 | A | * | 10/1950 | Boles | 297/241 |
| 4,569,555 | A | | 2/1986 | Lehman | |
| 5,988,738 | A | | 11/1999 | Blessing et al. | |
| 6,920,834 | B1 | * | 7/2005 | Pehta et al. | 108/147.21 |
| 7,571,959 | B2 | | 8/2009 | Griepentrog | |

* cited by examiner

*Primary Examiner* — Sarah B McPartlin
(74) *Attorney, Agent, or Firm* — Veronica-Adele R. Cao; Weiss & Moy, P.C.

(57) ABSTRACT

An adjustable workstation with a hideaway seat and method are disclosed. The table may be adjustable in height so that the workstation may be used as a sitting desk or a standing workstation. The chair is pivotably coupled to the table so that it may be extended and used for sitting or stowed away under the desk while the user stands. The workstation may also have wheels for mobility.

14 Claims, 11 Drawing Sheets

ADJUSTABLE WORKSTATION WITH HIDEAWAY SEAT AND METHOD

CROSS-REFERENCE TO RELATED APPLICATION

This application is a continuation of U.S. application Ser. No. 12/270,709 filed on Nov. 13, 2008 now U.S. Pat. No. 7,954,892 in the name of the Applicant herein.

FIELD OF THE INVENTION

The invention relates generally to furniture, and more specifically to an adjustable workstation with a hideaway seat and related method.

BACKGROUND OF THE INVENTION

Standing workstations are known in the art. Oftentimes, people utilizing such an apparatus will pull up a high stool or chair if they will be at their standing workstation for extended periods of time. However, when the standing workstations are in areas where there is much traffic (like in a hospital), there is no convenient place to store the high stool or chair. Also, there is a tendency for these high stools or chairs to be taken from one desk or standing workstation by another person to another desk or standing workstation, so that they may not be available when needed.

The present invention is directed to a workstation with a hideaway chair connected thereto.

SUMMARY OF THE INVENTION

In accordance with one embodiment of the present invention a workstation is disclosed. The workstation comprises, in combination: a table; a chair; and a pivotable connection arm connecting the table to the chair; wherein the pivotable connection arm permits alternate positioning of the chair outside of the table so that a user may sit thereon and utilize the table as a seated workstation or below the table so that a user may utilize the table as a standing workstation without contacting the chair.

In accordance with another embodiment of the present invention, a workstation is disclosed. The workstation comprises, in combination: a table; a height adjustment mechanism coupled to an underside of the table; a chair; and a pivotable connection arm connecting the chair to the height adjustment mechanism; wherein the pivotable connection arm permits alternate positioning of the chair outside of the table so that a user may sit thereon and utilize the table as a seated workstation or below the table so that a user may utilize the table as a standing workstation without contacting the chair; wherein the pivotable connection arm comprises: a first portion coupled to the height adjustment mechanism; a second portion coupled to the first portion and to the chair; and a hinge connecting the second portion to the first portion; and an opening in a front portion of the chair configured to mate with the height adjustment mechanism when the chair is below the table.

In accordance with another embodiment of the present invention, a method for alternately utilizing a workstation in a seated and standing configuration is disclosed. The method comprises: providing a table; providing a chair; providing a pivotable connection arm connecting the table to the chair; positioning the chair outside of the table by pivoting the chair along the pivotable connection arm so that a user may sit thereon and utilize the table as a seated workstation; and positioning the chair below the table by pivoting the chair along the pivotable connection arm so that a user may utilize the table as a standing workstation without contacting the chair.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

Figure 1:
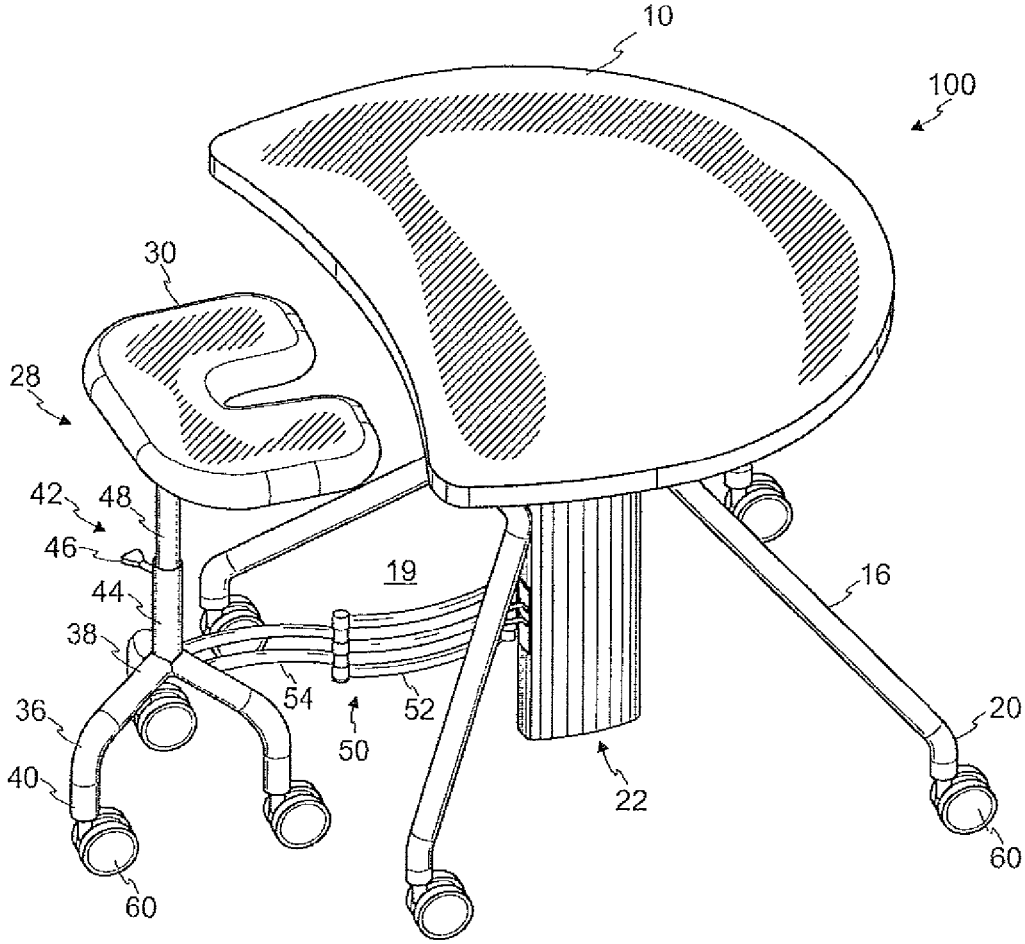
FIG. 1 is an elevated perspective view of an adjustable workstation consistent with an embodiment of the present invention. The workstation is shown in a desk position.
Figure 2:
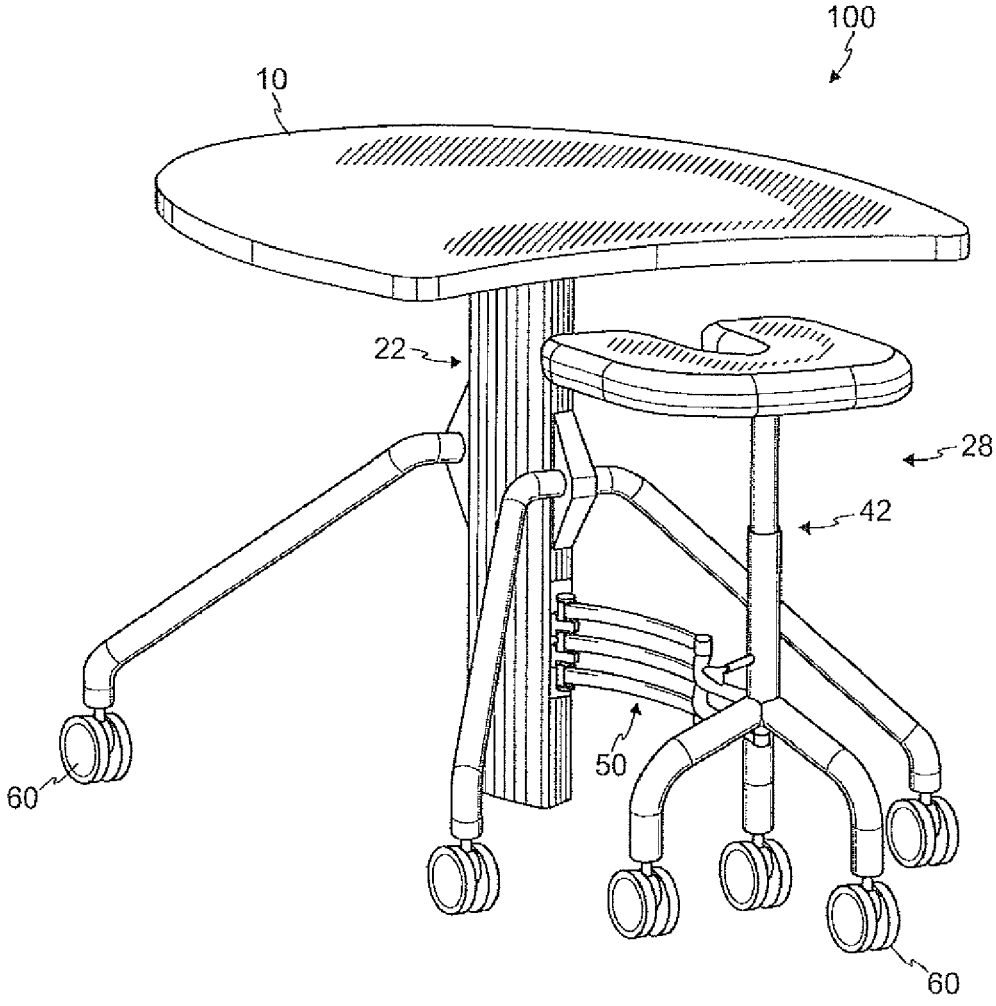
FIG. 2 is a perspective view of the workstation of FIG. 1.
Figure 3:
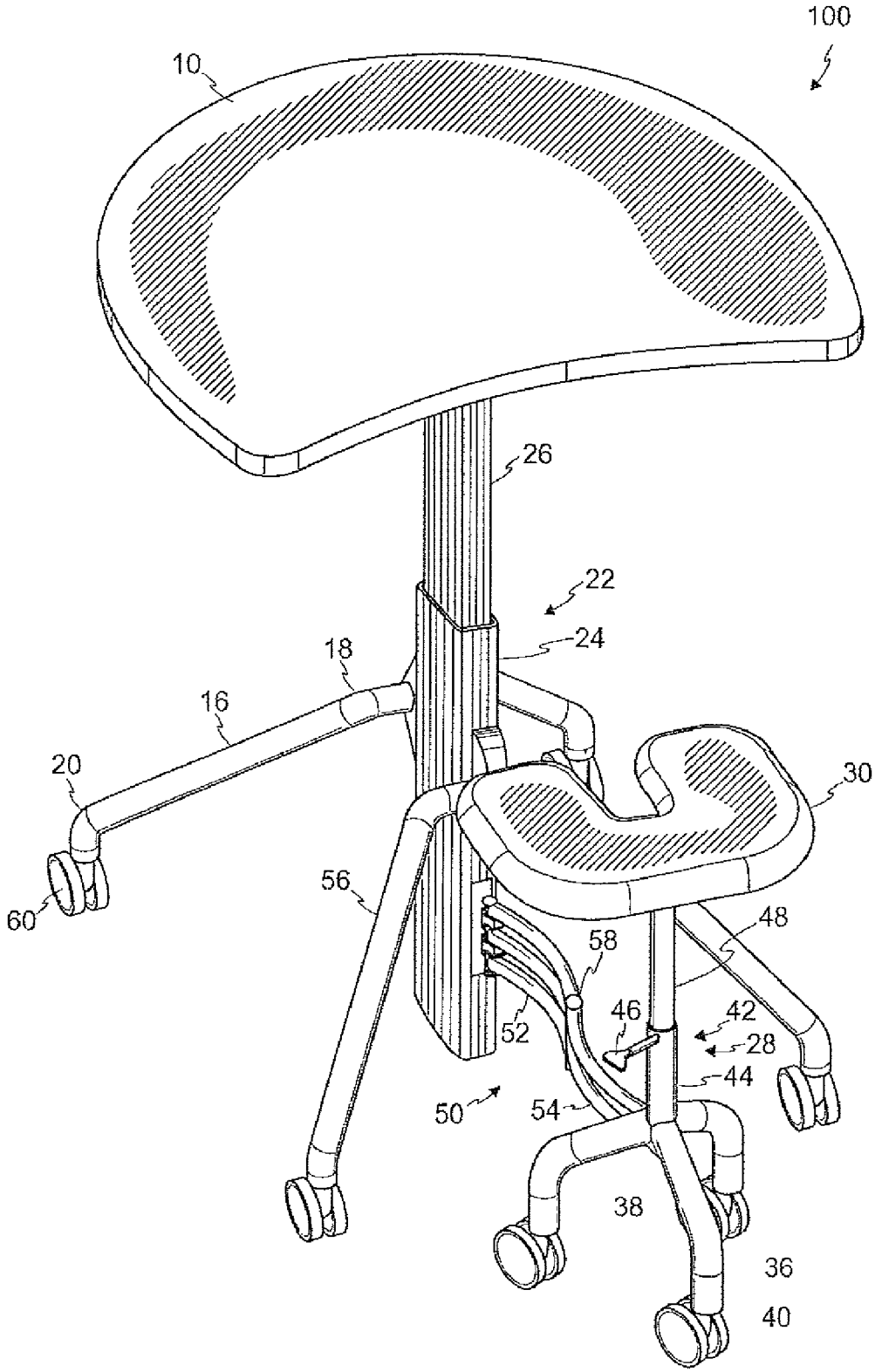
FIG. 3 is an elevated perspective view of the workstation of FIG. 1, shown in a standing workstation position.
Figure 4:
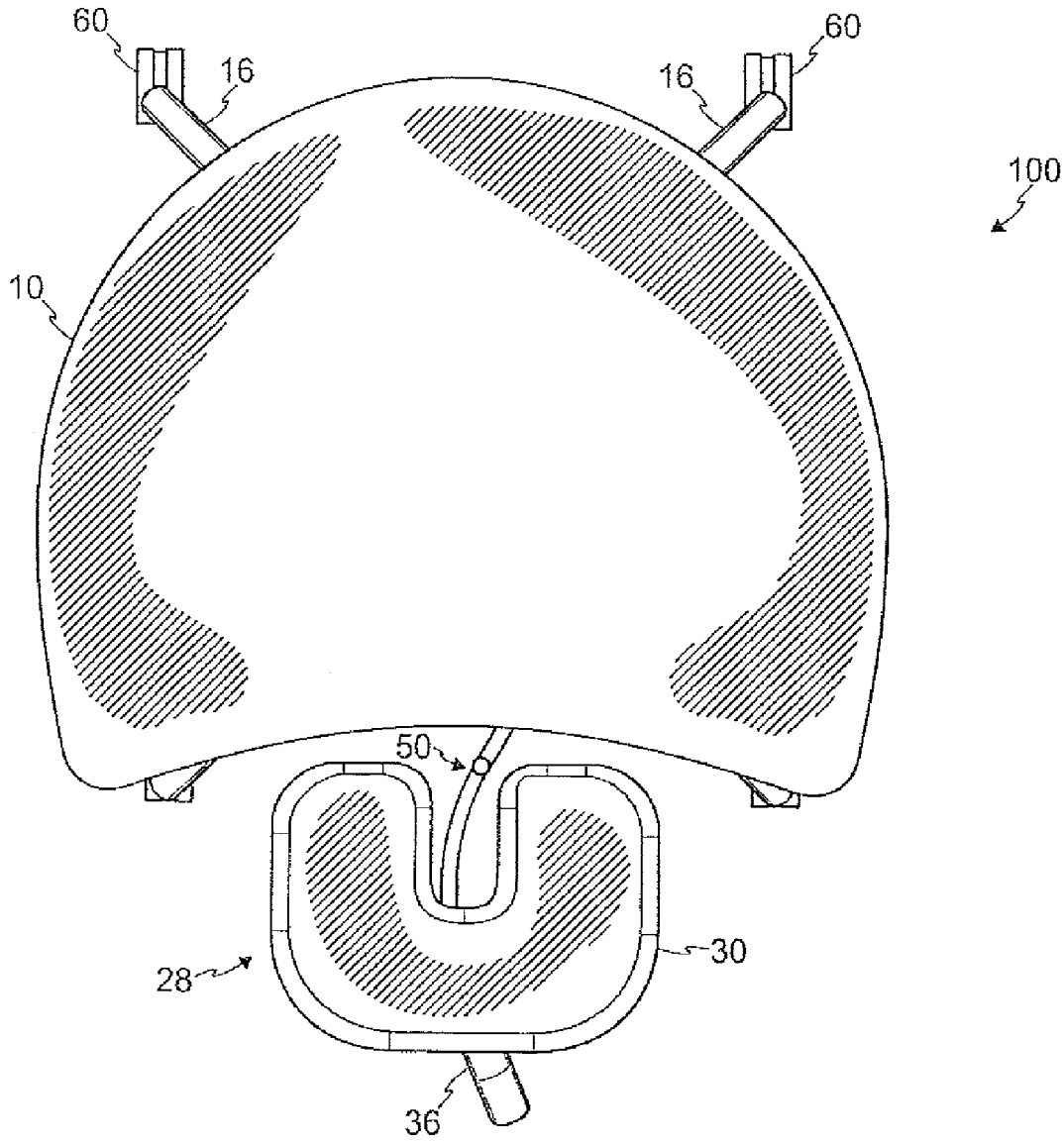
FIG. 4 is top view of the workstation of FIG. 1.
Figure 5:
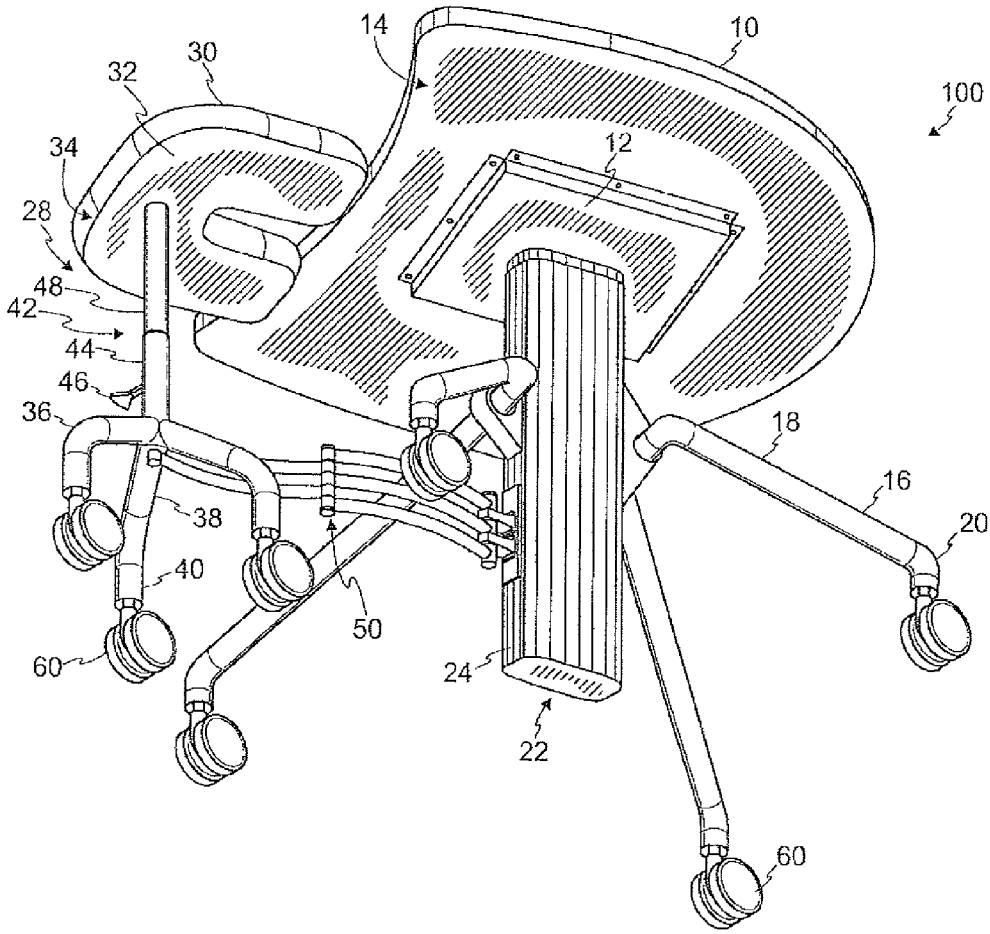
FIG. 5 is a bottom perspective view of the workstation of FIG. 1.
Figure 6:
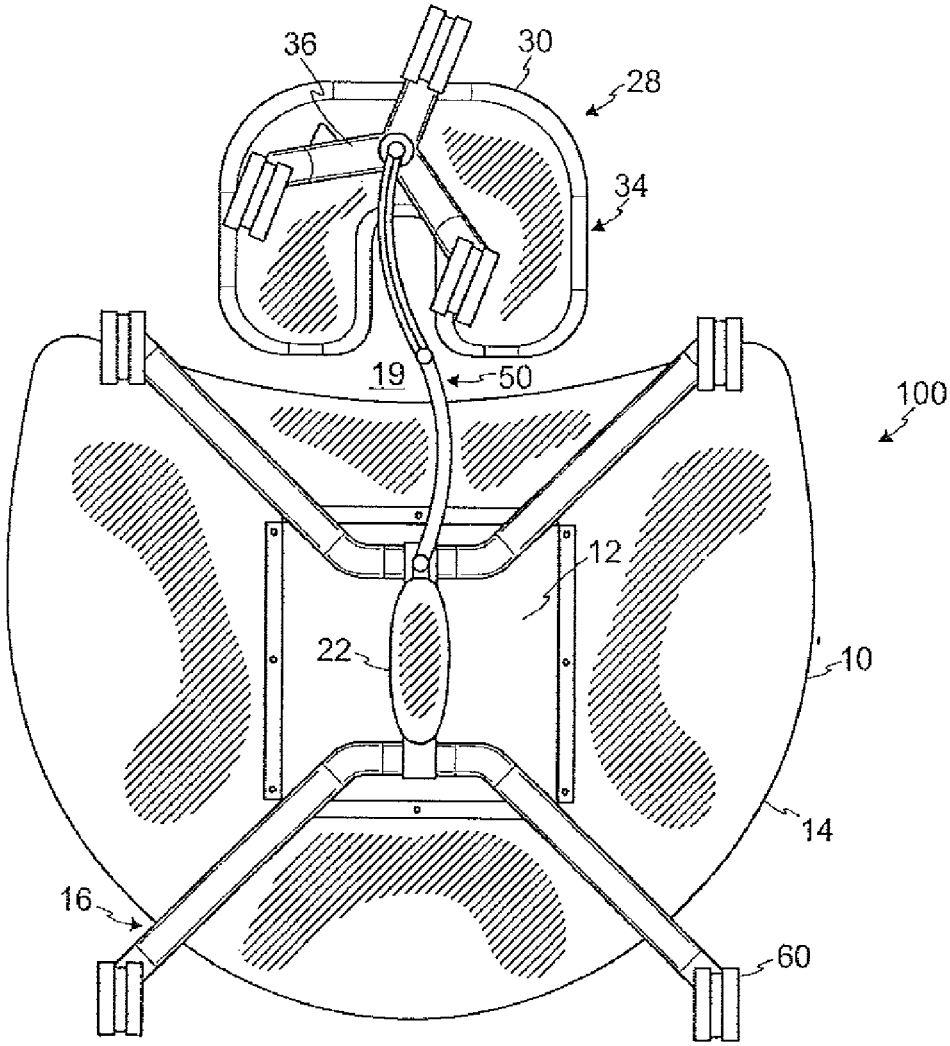
FIG. 6 is a bottom view of the workstation of FIG. 1.

The novel features believed characteristic of the invention are set forth in the appended claims. The invention will best be understood by reference to the following detailed description of illustrated embodiments when read in conjunction with the accompanying drawings, wherein like reference numerals and symbols represent like elements.

Referring to FIGS. 1-11, a workstation with a hideaway chair (hereinafter workstation 100) is shown. In its most basic form, the workstation 100 comprises a table 10, a chair 28, and a connection arm 50 connecting the table 10 to the chair 28. In one embodiment, the workstation 100 is height adjustable so that it may be used in a sitting desk position (see FIGS. 1, 2, 4, 5, 6, 7, 8, 10, and 11) or in a standing workstation position (see FIGS. 3 and 9).

As shown in the figures, one embodiment of the workstation 100 has a table height adjustment mechanism 22. The table height adjustment mechanism 22 has a base portion 24 and has a support member 26 that is housed within the base portion 24 and that is coupled at one end to a center portion 12 of a bottom surface 14 of the table 10. As the support member 26 is raised or lowered, the height of the table 10 is adjusted. The table height adjustment mechanism 22 may be pneumatic, although it should be clearly understood that substantial benefit may be derived from any suitable alternative adjustment mechanism. Although it is shown in the drawings that the workstation 100 has one table height adjustment mechanism coupled to the center portion 12 of the table 10, it should also be clearly understood that substantial benefit may be derived from more than one height adjustment mechanism 22 being used and being coupled at other areas of the table 10, such as at its ends.

The table 10 also may have four leg members 16, each with a proximal end 18 coupled proximate the table height adjustment mechanism 22 and a distal end 20. In one embodiment, the proximal ends 18 of two leg members 16 are coupled to a middle portion of the table height adjustment mechanism 22 by a first bracket 17 on a first side of the table height adjustment mechanism 22, and the proximal ends 18 of two other leg members 16 are coupled to the middle portion of the table height adjustment mechanism 22 by a second bracket 17 (see FIG. 7). In one embodiment, there is a space 19 (see FIGS. 1 and 6) between the two distal ends 20 of the two leg members 16 proximate the chair 28, wherein the space 19 is greater than the width of the chair 28. This will allow enough room for the chair 28 to be stowed under the table 10 when not in use.

The chair 28 has a seat 30 and, preferably, a plurality of legs 36. The seat 30 may have a U-shaped opening 27 in a front portion thereof to mate with the base portion 24 of the table height adjustment mechanism 22 (see FIGS. 9 and 10). It should be clearly understood, however, that substantial benefit may still be derived from a seat 30 that does not have such an opening.

Figure 7:
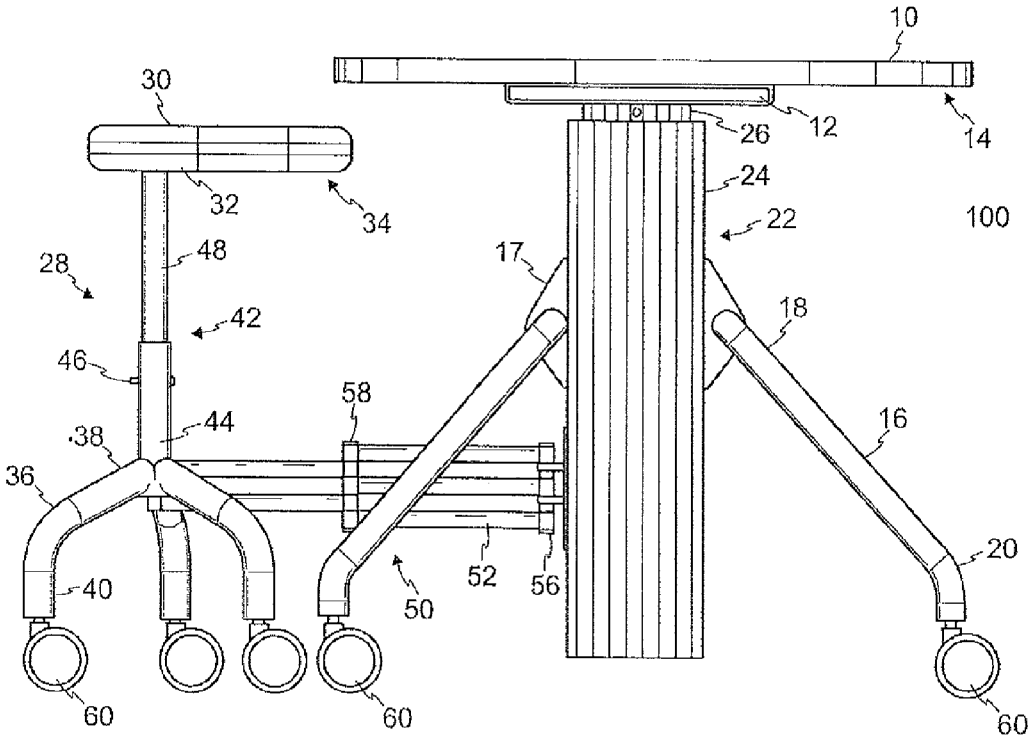
FIG. 7 is a side view of the workstation of FIG. 1.
Figure 8:
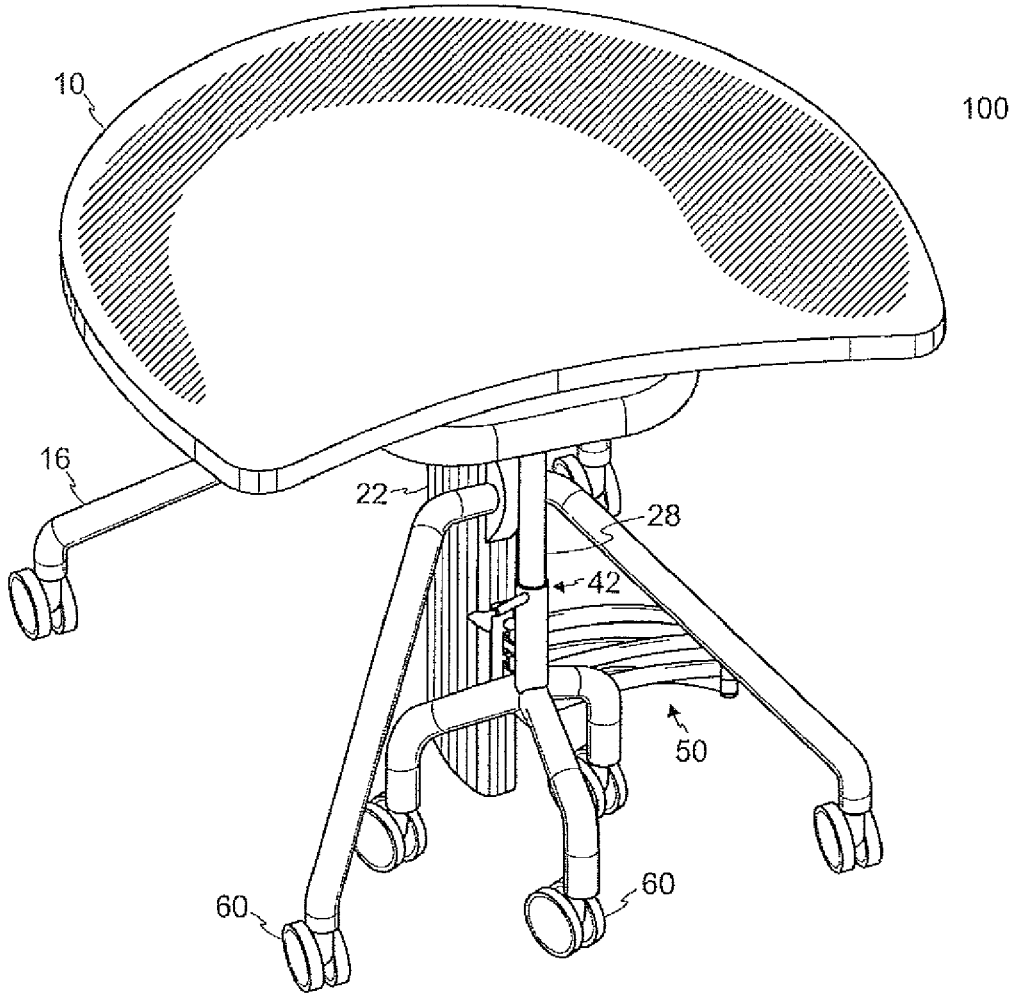
FIG. 8 is an elevated perspective view of the workstation of FIG. 1, shown with the seat in a stowed position.
Figure 9:
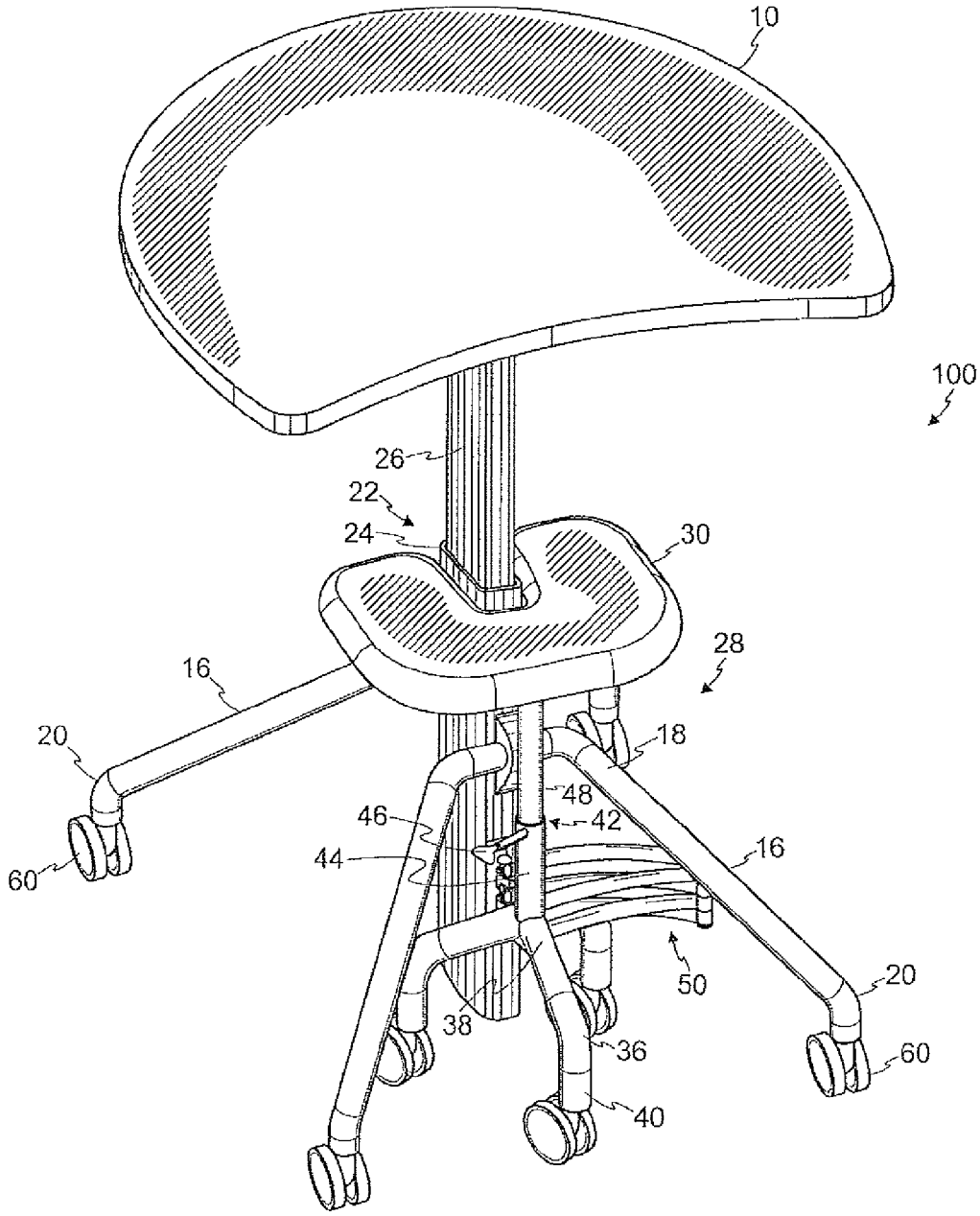
FIG. 9 is an elevated perspective view of the workstation of FIG. 3 shown with the seat in a stowed position.
Figure 10:
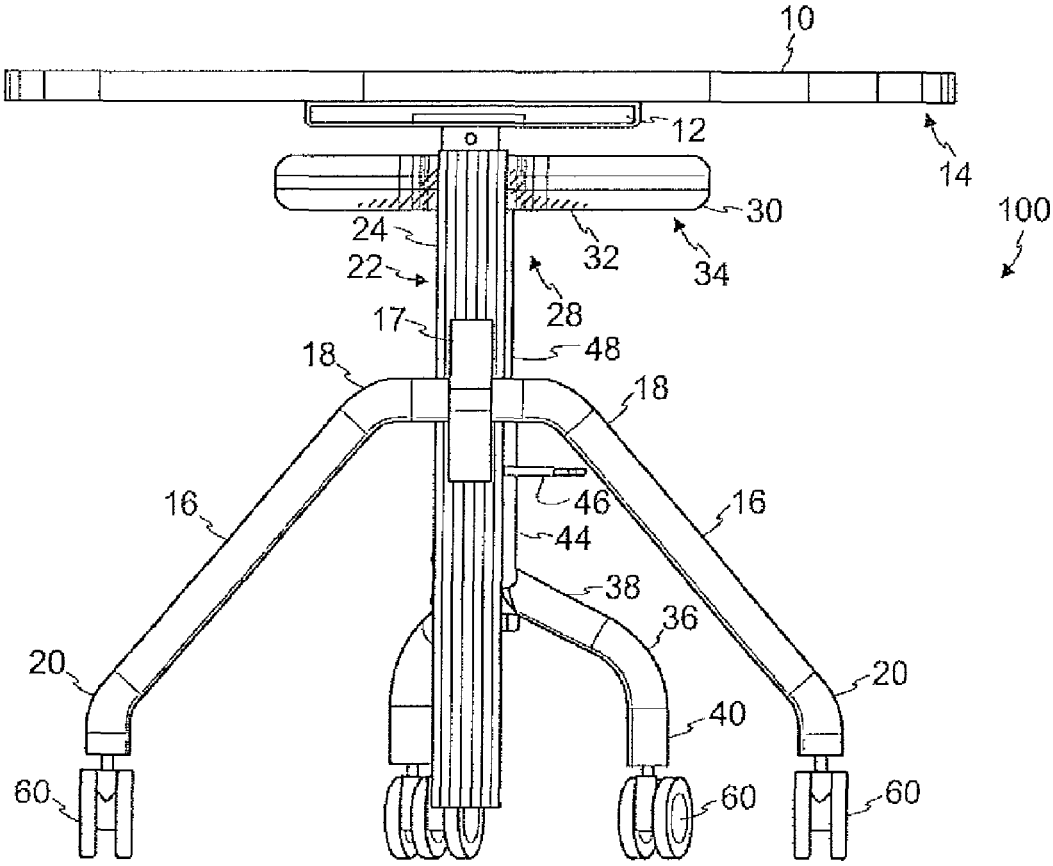
FIG. 10 is a rear view of the workstation of FIG. 8.
Figure 11:
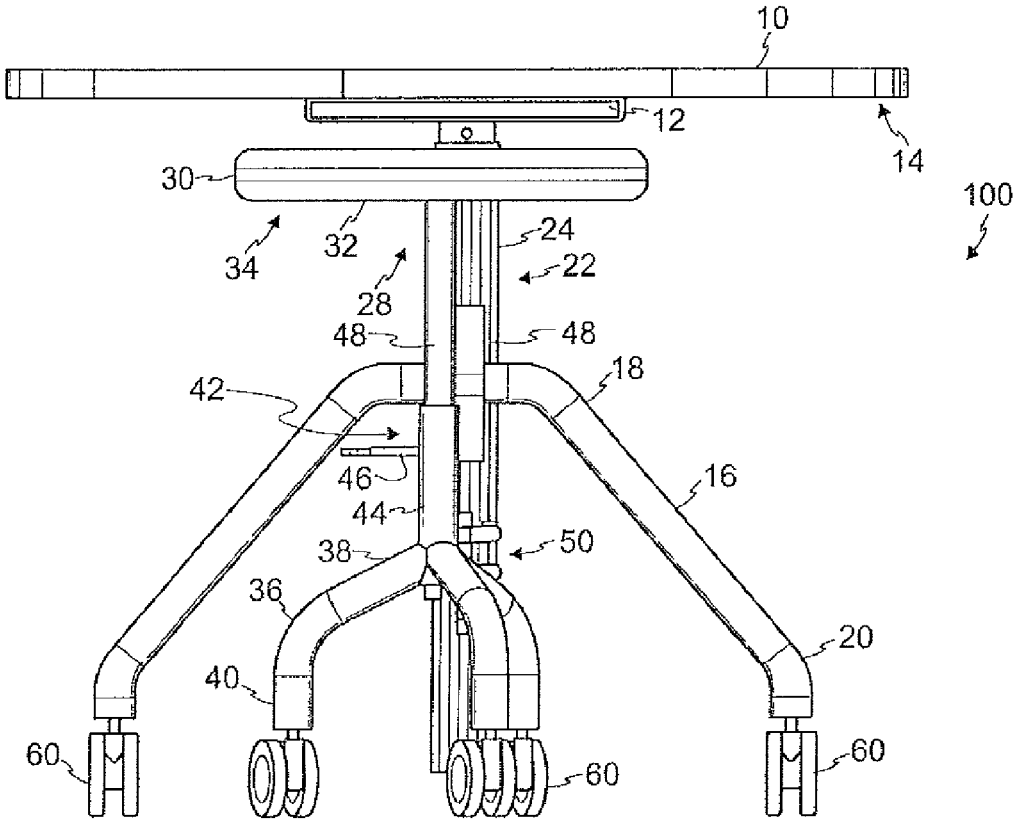
FIG. 11 is a front view of the workstation of FIG. 8.

In one embodiment, the workstation 100 has a chair height adjustment mechanism 42, as shown by way of example in FIG. 7. The chair height adjustment mechanism 42, in this embodiment, has a base portion 44 coupled to a proximal end 38 of each of the legs 36, an adjustment lever 46 coupled to the base portion 44, and a support member 48 that is housed within the base portion 44 and that is coupled at one end to a center portion 32 of a bottom surface 34 of the seat 30. As the support member 48 is raised or lowered, the height of the chair 28 is adjusted. The chair height adjustment mechanism 42 may be pneumatic, although it should be clearly understood that substantial benefit may be derived from any suitable alternative adjustment mechanism.

In one embodiment, the pivotable connection arm 50 has a first connection member 52 coupled to the base portion 24 of the table height adjustment mechanism 22 and a second connection member 54 coupled to the first connection member 52 and to the base portion 44 of the chair height adjustment mechanism 42. A first hinge 56 connects a proximal end of the first connection member 52 to the base portion 24 of the table height adjustment mechanism 22 and a second hinge 58 connects a proximal end of the second connection member 54 to a distal end of the first connection member 52. The first connection member 52 and the second connection member 54 may be curved and coupled to each other at the second hinge 58 in opposing directions. Thus, when the chair 28 is in a stowed position, the second connection member 54 folds into the first connection member 52 and the connection arm 50 is curved away from the front of the workstation where a user would usually stand.

As shown in the Figures, one embodiment of the workstation 100 may have wheels 60 coupled to the distal ends 20 of the table leg members 16 and to the distal ends 40 of the chair leg members 36. Although it should be clearly understood that substantial benefit may be derived from a workstation 100 that does not have wheels 60.

While the invention has been particularly shown and described with reference to preferred embodiments thereof, it will be understood by those skilled in the art that the foregoing and other changes in form and details may be made therein without departing from the spirit and scope of the invention.

I claim:

1. A workstation comprising:

a table having at least one support member coupled at a proximal end thereof to an underside of the table;

a chair having a plurality of legs;

a pivotable connection member connecting the chair to the support member of the table;

a table height adjustment mechanism coupled at a proximal end thereof to the underside of the table; and a plurality of table leg members coupled at a proximal end thereof to the table height adjustment mechanism and wherein two of the plurality of leg members most proximate the chair are positioned so as to define a space therebetween that is greater than a width of the chair;

wherein the pivotable connection member permits alternate positioning of the chair outside of the table so that a user may sit thereon and utilize the table as a seated workstation or below the table so that a user may utilize the table as a standing workstation without contacting the chair; and wherein the pivotable connection member permits a distal end of each of the plurality of legs of the chair to remain on a same horizontal plane as a distal end of the support member of the table while the chair moves between the alternate positions.

2. The workstation of claim 1 wherein the table height adjustment mechanism comprises:

a base portion; and wherein the support member of the table is housed within the base portion of the table height adjustment mechanism; and wherein the base portion of the table height adjustment mechanism and the support member of the table are permitted to move in relation to one another so that a height of the table may be varied.

3. The workstation of claim 1 wherein the chair further comprises:

a seat;

an opening in a front portion of the seat configured to mate with the support member of the table when the chair is below the table; and a plurality of wheels, each wheel coupled to a distal end of one of the legs; and wherein the plurality of legs are each coupled at a proximal end thereof to the seat.

4. The workstation of claim 3 wherein the chair further comprises a chair height adjustment mechanism coupled between the seat and the legs and wherein the chair height adjustment mechanism comprises:

a base portion coupled to a proximal end of each of the legs; and a support member that is housed within the base portion of the chair height adjustment mechanism and that is coupled at a proximal end thereof to a center portion of an underside of the seat;

wherein the base portion of the chair height adjustment mechanism and the support member of the chair height adjustment mechanism are permitted to move in relation to one another so that a height of the chair may be varied.

5. The workstation of claim 4 further comprising a table height adjustment mechanism, wherein the table height adjustment mechanism comprises:

a base portion; and wherein the support member of the table is housed within the base portion of the table height adjustment mechanism; and wherein the base portion of the table height adjustment mechanism and the support member of the table are permitted to move in relation to one another so that a height of the table may be varied.

6. The workstation of claim 5 wherein the pivotable connection member comprises:

a first connection member coupled to the base portion of the table height adjustment mechanism;

a first hinge coupling a proximal end of the first connection member to the base portion of the table height adjustment mechanism;

a second connection member coupled to the first connection member and to the base portion of the chair height adjustment mechanism; and a second hinge connecting a proximal end of the second connection member to a distal end of the first connection member.

7. The workstation of claim 1 wherein the pivotable connection member comprises:

a first connection member coupled to the support member of the table;

a first hinge coupling a proximal end of the first connection member to the support member of the table;

a second connection member coupled to the first connection member and to the chair; and a second hinge connecting the second connection member to the first connection member.

8. The workstation of claim 7 wherein the first connection member and the second connection member each have a curved length and are coupled to each other at the second hinge such that they are curved in opposing directions, and when the pivotable connection member is in a folded position, the pivotable connection member curves away from a front portion of the table.

9. A workstation comprising:

a table having at least one support member coupled at a proximal end thereof to an underside of the table;

a chair having a plurality of legs;

a pivotable connection member connecting the chair to the support member of the table wherein the pivotable connection member comprises:

a first connection member coupled to the support member of the table;

a second connection member coupled to the first connection member and to the chair; and a hinge connecting the second connection member to the first connection member;

a table height adjustment mechanism, wherein the table height adjustment mechanism comprises:

a base portion;

wherein the support member of the table is housed within the base portion of the table height adjustment mechanism; and wherein the base portion of the table height adjustment mechanism and the support member of the table are permitted to move in relation to one another so that a height of the table may be varied; and a plurality of table leg members coupled at a proximal end thereof to the table height adjustment mechanism and wherein two of the plurality of leg members most proximate the chair are positioned so as to define a space therebetween that is greater than a width of the chair;

wherein the pivotable connection member permits alternate positioning of the chair outside of the table so that a user may sit thereon and utilize the table as a seated workstation or below the table so that a user may utilize the table as a standing workstation without contacting the chair; and wherein the pivotable connection member permits a distal end of each of the plurality of legs of the chair to remain on a same horizontal plane as a distal end of the support member of the table while the chair moves between the alternate positions.

10. The workstation of claim 9 wherein the first connection member and the second connection member each have a curved length and are coupled to each other at the hinge such that they are curved in opposing directions, and when the pivotable connection member is in a folded position, the pivotable connection member curves away from a front portion of the table.

11. The workstation of claim 9 further comprising a second hinge connecting the first connection member to the support member of the table.

12. The workstation of claim 9 wherein the chair further comprises:

a seat;

an opening in a front portion of the seat configured to mate with the support member of the table when the chair is below the table;

a plurality of wheels, each wheel coupled to a distal end of one of the legs; and wherein the plurality of legs are each coupled at a proximal end thereof to the seat.

13. The workstation of claim 12 wherein the chair further comprises a chair height adjustment mechanism coupled between the seat and the legs and wherein the chair height adjustment mechanism comprises:

a base portion coupled to the proximal end of each of the legs; and a support member that is housed within the base portion of the chair height adjustment mechanism and that is coupled at a proximal end thereof to a center portion of an underside of the seat;

wherein the base portion of the chair height adjustment mechanism and the support member of the chair height adjustment mechanism are permitted to move in relation to one another so that a height of the chair may be varied.

14. A workstation comprising:

a table having at least one support member coupled at a proximal end thereof to an underside of the table;

a chair comprising:

a seat;

a plurality of legs, each leg coupled at a proximal end thereof to the seat;

a plurality of wheels, each wheel coupled to a distal end of one of the legs of the chair;

a pivotable connection member connecting the chair to the support member of the table;

wherein the pivotable connection member permits alternate positioning of the chair outside of the table so that a user may sit thereon and utilize the table as a seated workstation or below the table so that a user may utilize the table as a standing workstation without contacting the chair;

a table height adjustment mechanism, wherein the table height adjustment mechanism comprises a base portion and wherein the support member of the table is housed within the base portion of the table height adjustment mechanism; and wherein the base portion of the table height adjustment mechanism and the support member of the table are permitted to move in relation to one another so that a height of the table may be varied;

a chair height adjustment mechanism coupled between the seat of the chair and the legs of the chair and wherein the chair height adjustment mechanism comprises:

a base portion coupled to the proximal end of each of the legs of the chair; and a support member that is housed within the base portion of the chair height adjustment mechanism and that is coupled at a proximal end thereof to a center portion of an underside of the seat of the chair;

wherein the base portion of the chair height adjustment mechanism and the support member of the chair height adjustment mechanism are permitted to move in relation to one another so that a height of the chair may be varied;

a plurality of table leg members coupled at a proximal end thereof to the table height adjustment mechanism and wherein two of the plurality of table leg members most proximate the chair are positioned so as to define a space therebetween that is greater than a width of the chair; and a plurality of wheels, each wheel coupled to a distal end of one the table leg members;

wherein the wheels of the legs of the chair remain on a same horizontal plane as the wheels of the table leg members while the chair moves between the alternate positions.

* * * * *